US008237749B2

(12) United States Patent
Kim et al.

(10) Patent No.: US 8,237,749 B2
(45) Date of Patent: Aug. 7, 2012

(54) IMAGE DISPLAY DEVICE AND METHOD FOR CORRECTING DISPLAY CHARACTERISTIC THEREOF

(75) Inventors: Tae-hee Kim, Suwon-si (KR); Jae-young Choi, Jeonju-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1110 days.

(21) Appl. No.: 12/124,683

(22) Filed: May 21, 2008

(65) Prior Publication Data

US 2009/0066731 A1 Mar. 12, 2009

(30) Foreign Application Priority Data

Sep. 7, 2007 (KR) ..... 10-2007-0091070

(51) Int. Cl.
*G09G 5/02* (2006.01)

(52) U.S. Cl. ..... 345/690; 345/86; 345/87; 345/88; 345/89; 345/90; 345/600; 345/601; 345/602; 345/603; 345/604; 345/605; 345/104; 345/204

(58) Field of Classification Search ..... 345/86–104, 345/204, 600–605, 690
See application file for complete search history.

(56) References Cited

U.S. PATENT DOCUMENTS 4,379,292 A * 4/1983 Minato et al. ..... 345/603
6,664,973 B1 * 12/2003 Iwamoto et al. ..... 345/589
6,757,425 B2 * 6/2004 Pettigrew et al. ..... 382/162
2006/0279523 A1 * 12/2006 Nitta et al. ..... 345/102
2007/0046690 A1 * 3/2007 Madden et al. ..... 345/590

FOREIGN PATENT DOCUMENTS

KR 1020060022147 A 3/2006

* cited by examiner

*Primary Examiner* — Alexander S Beck
*Assistant Examiner* — Jeffrey Steinberg
(74) *Attorney, Agent, or Firm* — Sughrue Mion, PLLC

(57) ABSTRACT

An image display device and a method for correcting a display characteristic thereof are provided. The image display device includes a composite color luminance determination unit which determines luminance of a composite color using luminance of a neutral color and luminance of a pure chromatic color, a display unit which displays an image signal using the luminance of the neutral color and the luminance of the pure chromatic color and the determined luminance of the composite color, a display characteristic measurement unit which measures a display characteristic parameter from the displayed image signal, and a display characteristic correction unit which corrects a display characteristic according to a result of comparing the measured display characteristic parameter and a preset target value. Accordingly, an accurate gamma correction can be performed.

24 Claims, 3 Drawing Sheets

IMAGE DISPLAY DEVICE AND METHOD FOR CORRECTING DISPLAY CHARACTERISTIC THEREOF

CROSS-REFERENCE TO RELATED APPLICATIONS

This application claims priority from Korean Patent Application No. 10-2007-91070, filed Sep. 7, 2007, in the Korean Intellectual Property Office, the disclosure of which is incorporated herein by reference in its entirety.

BACKGROUND OF THE INVENTION

1. Field of the Invention

Methods and apparatuses consistent with the present invention relate to an image display device and correcting a display characteristic thereof, and more particularly, to an image display device which adjusts a gamma according to a saturation value and correcting a display characteristic thereof.

2. Description of the Related Art

In general, a display device has a lookup table (LUT) to convert an input grayscale level into a desirable output grayscale level. The lookup table provided in the display device is prepared for each of RGB colors.

Among the display devices, a liquid crystal display (LCD) has been widely used in various devices such as a monitor, a laptop, a TV, and a mobile communication terminal. Accordingly, there has been a demand for a high display quality of the LCD.

A setting of gamma is an important factor in improving the display quality of the LCD. The setting of gamma is performed according to a gamma curve which defines a correlation between a display luminance and grayscale data, and in order to maintain the display quality at a stable level, a very accurate setting of gamma is required.

Practically, errors frequently occur in various factors of the LCD, such as a distribution among components, a cell gap of a liquid crystal panel, a variation in the thickness of color filter, and a driving voltage. Although a gamma of a panel accurately reaches a target value by controlling these factors, a tolerance for a target gamma may occur.

Since the LCD does not allow an additive color mixture, the LCD uses a lookup table where a gamma characteristic is adjusted for each single color of RGB to display a white color. In this case, the gamma characteristic deviates from an original gamma characteristic in the white color, and due to the deviation of the gamma characteristic in the white color, a grayscale is not accurately expressed in a black-and-white image.

Korean Patent Laid-open No. 2006-0022147 discloses an automatic gamma setting system which measures luminance and corrects a white color gamma and a method thereof. It is important to correct a white color gamma in order to reproduce accurate colors in the LCD. However, besides this white color gamma correction, a white color coordinates correction and a RGB primary color gamma correction are also important. The conventional automatic gamma setting system and the method thereof has a problem in that it corrects the white color gamma only.

Also, in the conventional automatic gamma setting system and the method thereof, the accuracy of color reproduction is determined depending on the accuracy of an output color estimation equation which is created using a small number of color measurement values. Therefore, the accuracy is not guaranteed if a predetermined target value is input.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides an image display device which adaptively adjusts a gamma according to a saturation value and applies an accurate gamma to an image, thereby improving the accuracy of color reproduction, and a method for correcting a display characteristic thereof.

According to an aspect of the present invention, there is provided an image display device, including a composite color luminance determination unit which determines luminance of a composite color using luminance of a neutral color and luminance of a pure chromatic color, a display unit which displays an image signal using the luminance of the neutral color, the luminance of the pure chromatic color and the determined luminance of the composite color, a display characteristic measurement unit which measures a display characteristic parameter from the displayed image signal, and a display characteristic correction unit which corrects a display characteristic according to a result of comparing the measured display characteristic parameter and a preset target value.

The display characteristic correction unit may create a lookup table having luminance levels for each of input grayscale levels required to reproduce the preset target value, display an image signal to which the lookup table is applied through the display unit, measure a display characteristic parameter from the displayed image signal through the display characteristic measurement unit, and create a final lookup table according to a result of comparing the measured display characteristic parameter and the target value.

The display characteristic correction unit may create a lookup table for each of the neutral color, the pure chromatic color, and the composite color.

The composite color luminance determination unit may extract the luminance of the neutral color and the luminance of the pure chromatic color from the created lookup tables to determine the luminance of the composite color.

The image display device may further include a saturation calculation unit which calculates a saturation of each pixel of the image signal, and the composite color luminance determination unit may extract luminance from the lookup table for the neutral color if the calculated saturation value is 0, extract luminance from the lookup table for the pure chromatic color if the calculated saturation value is 1, and extract luminance from the lookup table for the composite color if the calculated saturation value is neither 0 nor 1.

The saturation calculation unit may calculate the saturation value by the following equation:

$$S = 1 - \frac{\mathrm{Min}(R, G, B)}{\mathrm{Max}(R, G, B)}$$

wherein 'S' denotes the saturation, Min(R,G,B) denotes a minimum value of R, G, B, and Max(R,G,B) denotes a maximum value of R, G, B.

The composite color luminance determination unit may calculate the luminance of the neutral color and the luminance of the pure chromatic color by the following equation:

$$TY_{Wn} = \left(\frac{n}{255}\right)^{T_{Gamma}} \times Y_{W255} + Y_{W0}$$

wherein 'n' ranges from 0 to 255, $TY_{Wn}$ denotes target luminance for the $n^{th}$ input grayscale, $Y_{W255}$ denotes a white luminance if an input grayscale is at a maximum level, $Y_{W0}$ denotes a black luminance if an input grayscale is at a minimum level, and $T_{Gamma}$ denotes a target gamma.

The composite color luminance determination unit may calculate luminance of the composite color by the following equation:

$$Y_{composite\text{-}n}=(1-S)Y_{neutral\text{-}n}+SY_{pure\text{-}n}$$

wherein 'n' ranges from 0 to 255, $Y_{composite\text{-}n}$ denotes composite color luminance for the $n^{th}$ input grayscale, 'S' denotes a saturation, $Y_{neutral\text{-}n}$ denotes luminance of the neutral color for the $n^{th}$ input grayscale, and $Y_{pure\text{-}n}$ denotes luminance of the pure chromatic color for the $n_{th}$ input grayscale.

If the display characteristic parameter measured for the $n^{th}$ input grayscale is less than the target value, the display characteristic correction unit may output R, G, B of the $n+1^{th}$ input grayscale. If the display characteristic parameter measured for the $n^{th}$ input grayscale is greater than the target value, the display characteristic correction unit may output R, G, B of the $n-1^{th}$ input grayscale.

The display characteristic correction unit may correct the display characteristic by the following equation:

$$\begin{pmatrix} R_{n+1} \\ G_{n+1} \\ B_{n+1} \end{pmatrix} = \begin{pmatrix} X_{panel,r} & X_{panel,g} & X_{panel,b} \\ Y_{panel,r} & Y_{panel,g} & Y_{panel,b} \\ Z_{panel,r} & Z_{panel,g} & Z_{panel,b} \end{pmatrix}^{-1} \begin{pmatrix} X_{tgt,n+1} \\ Y_{tgt,n+1} \\ Z_{tgt,n+1} \end{pmatrix}$$

$$X_{tgt,n+1} = X_{tgt,n}\frac{X_{tgt}}{X_{panel}}$$

$$Y_{tgt,n+1} = Y_{tgt,n}\frac{Y_{tgt}}{Y_{panel}}$$

$$Z_{tgt,n+1} = Z_{tgt,n}\frac{Z_{tgt}}{Z_{panel}},$$

wherein $(X_{tgt,n}, Y_{tgt,n}, Z_{tgt,n})$ denotes a tristimulus value of the $n^{th}$ target, $(X_{panel}, Y_{panel}, Z_{panel})$ denotes a tristimulus value measured by the display characteristic measurement unit, and $(X_{tgt}, Y_{tgt}, Z_{tgt})$ denotes a tristimulus value of a desirable final output target.

According to an aspect of the present invention, there is provided a method for correcting a display characteristic of an image display device, the method including determining luminance of a composite color using luminance of a neutral color and luminance of a pure chromatic color, displaying an image signal using the luminance of the neutral color, the luminance of the pure chromatic color and the determined luminance of the composite color, measuring a display characteristic parameter from the displayed image signal, and correcting a display characteristic according to a result of comparing the measured display characteristic parameter and a preset target value.

The method may further include creating a lookup table having luminance levels for each of input grayscale levels required to reproduce the preset target value, displaying an image signal to which the lookup table is applied, measuring a display characteristic parameter from the displayed image signal, and creating a final lookup table according to a result of comparing the measured display characteristic parameter and the target value.

The creating the final lookup table may create a lookup table for each of the neutral color, the pure chromatic color, and the composite color.

The determining the luminance of the composite color may extract the luminance of the neutral color and the luminance of the pure chromatic color from the created lookup tables to determine the luminance of the composite color.

The method may further include calculating a saturation of each pixel of the image signal, and the determining the luminance of the composite color may extract luminance from the lookup table for the neutral color if the calculated saturation value is 0, extract luminance from the lookup table for the pure chromatic color if the calculated saturation value is 1, and extract luminance from the lookup table for the composite color if the calculated saturation is neither 0 nor 1.

The calculating the saturation value may calculate the saturation value by the following equation:

$$S = 1 - \frac{\mathrm{Min}(R, G, B)}{\mathrm{Max}(R, G, B)}$$

wherein 'S' denotes the saturation, Min(R,G,B) denotes a minimum value of R (red), G (green), B (blue), and Max(R, G,B) denotes a maximum value of R, G, B.

The determining the luminance of the composite color may calculate the luminance of the neutral color and the luminance of the pure chromatic color by the following equation:

$$TY_{Wn} = \left(\frac{n}{255}\right)^{T_{Gamma}} \times Y_{W255} + Y_{W0}$$

wherein 'n' ranges from 0 to 255, $TY_{Wn}$, denotes target luminance for the $n^{th}$ input grayscale, $Y_{W255}$ denotes white luminance if an input grayscale is at a maximum level, $Y_{W0}$ denotes black luminance if an input grayscale is at a minimum level, and $T_{Gamma}$ denotes a target gamma.

The determining the luminance of the composite color may calculate the luminance of the composite color by the following equation:

$$Y_{composite\text{-}n}=(1-S)Y_{neutral\text{-}n}+SY_{pure\text{-}n}$$

wherein 'n' ranges from 0 to 255, $Y_{composite\text{-}n}$ denotes composite color luminance for the $n^{th}$ input grayscale, 'S' denotes a saturation, $Y_{neutral\text{-}n}$ denotes luminance of the neutral color for the $n^{th}$ input grayscale, and $Y_{pure\text{-}n}$ denotes luminance of the pure chromatic color for the $n^{th}$ input grayscale.

The correcting the display characteristic may output R, G, B of the $n+1^{th}$ input grayscale if the display characteristic parameter measured for the $n^{th}$ input grayscale is less than the target value. The correcting the display characteristic may output R, G, B of the $n-1^{th}$ input grayscale if the display characteristic parameter measured for the $n^{th}$ input grayscale is greater than the target value.

The correcting the display characteristic may correct the display characteristic by the following equation:

$$\begin{pmatrix} R_{n+1} \\ G_{n+1} \\ B_{n+1} \end{pmatrix} = \begin{pmatrix} X_{panel,r} & X_{panel,g} & X_{panel,b} \\ Y_{panel,r} & Y_{panel,g} & Y_{panel,b} \\ Z_{panel,r} & Z_{panel,g} & Z_{panel,b} \end{pmatrix}^{-1} \begin{pmatrix} X_{tgt,n+1} \\ Y_{tgt,n+1} \\ Z_{tgt,n+1} \end{pmatrix}$$

$$X_{tgt,n+1} = X_{tgt,n} \frac{X_{tgt}}{X_{panel}}$$

$$Y_{tgt,n+1} = Y_{tgt,n} \frac{Y_{tgt}}{Y_{panel}}$$

$$Z_{tgt,n+1} = Z_{tgt,n} \frac{Z_{tgt}}{Z_{panel}},$$

wherein ($X_{tgt,n}$, $Y_{tgt,n}$, $Z_{tgt,n}$) denotes a tristimulus value of the $n^{th}$ target, ($X_{panel}$, $Y_{panel}$, $Z_{panel}$) denotes a tristimulus value measured by the display characteristic measurement unit, and ($X_{tgt}$, $Y_{tgt}$, $Z_{tgt}$) denotes a tristimulus value of a desirable final output target.

BRIEF DESCRIPTION OF THE DRAWINGS

Above and other aspects of the present invention will become apparent and more readily appreciated from the following description of exemplary embodiments, taken in conjunction with the accompany drawings of which.

DETAILED DESCRIPTION OF EXEMPLARY EMBODIMENTS

Figure 1:
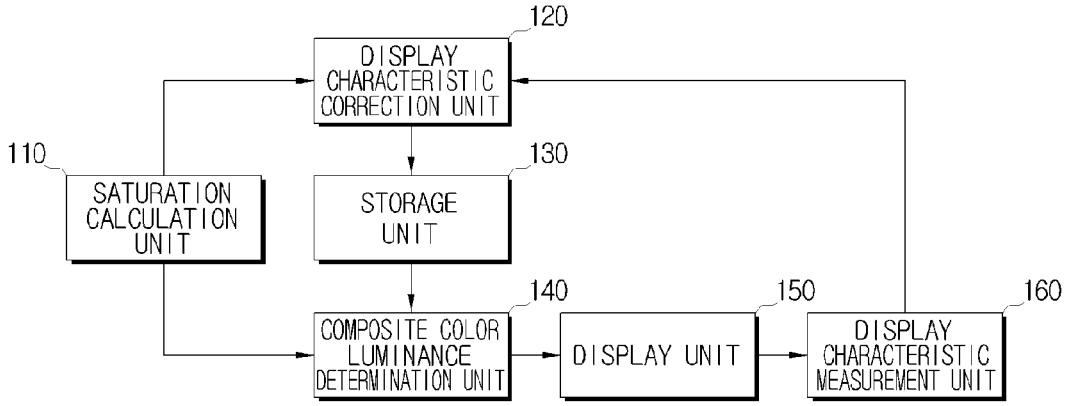
FIG. 1 is a block diagram illustrating an image display device according to an exemplary embodiment of the present invention.

Certain exemplary embodiments of the present invention will be described in greater detail with reference to the accompanying drawings.

In the following description, the same drawing reference numerals are used for the same elements even in different drawings. The matter defined in the description, such as detailed construction and elements, are provided to assist in a comprehensive understanding of the invention. Thus, it is apparent that the exemplary embodiments of the present invention can be carried out without this specifically defined matter. Also, well-known functions or constructions are not described in excessive detail since they would obscure the invention unnecessarily.

FIG. 1 is a block diagram illustrating an image display device according to an exemplary embodiment of the present invention.

Referring to FIG. 1, an image display device according to an exemplary embodiment of the present invention comprises a saturation calculation unit 110, a display characteristic correction unit 120, a storage unit 130, a composite color luminance determination unit 140, a display unit 150, and a display characteristic measurement unit 160.

The saturation calculation unit 110 calculates a saturation in the pixels of an image signal. The saturation calculation unit 110 calculates a saturation S by the following equation 1:

$$S = 1 - \frac{\mathrm{Min}(R, G, B)}{\mathrm{Max}(R, G, B)} \qquad \text{[Equation 1]}$$

wherein Min(R,G,B) denotes a minimum value of R, G, B and Max(R,G,B) denotes a maximum value of R, G, B.

The type of color is determined according to a saturation value calculated by the saturation calculation unit 110. More specifically, if a saturation value is 0, a neutral color is determined, and if a saturation value is 1, a pure chromatic color is determined. If a saturation value is neither 0 nor 1, a composite color is determined.

That is, the neutral color has a saturation value of 0 and is a color where the R, G, B are mixed in the same ratio. The pure chromatic color has a saturation value of 1. If the pure chromatic color is a red color, red is 1, and green and blue are 0. The composite color has a saturation value ranging between zero and one (0<saturation<1) and is a color where the R, G, B are mixed in a predetermined ratio.

The display characteristic correction unit 120 creates a lookup table for each neutral color, the pure chromatic color, and the composite color. That is, the display characteristic correction unit 120 creates a lookup table having a luminance level for each input grayscale level to reach a preset target value, displays an image signal to which the created lookup table is applied through the display unit 150, measures a display characteristic parameter from the displayed image signal through the display characteristic measurement unit 160, and creates a final lookup table according to a result of comparing the measured display characteristic parameter and a target value. The lookup table created by the display characteristic correction unit 120 is stored in the storage unit 130.

In creating the lookup table, the display characteristic correction unit 120 operates such that, if a display characteristic parameter measured for the $n^{th}$ input grayscale is less than a target value, the display characteristic correction unit 120 outputs R, G, B of the $n+1^{th}$ input grayscale, and if the measured display characteristic parameter is larger than the target value, it outputs R, G, B of the $n-1^{th}$ input grayscale. Herein, 'n' ranges from 0 to 255 grayscale levels.

Also, the display characteristic correction unit 120 corrects a display characteristic using the following equation 2:

$$\begin{pmatrix} R_{n+1} \\ G_{n+1} \\ B_{n+1} \end{pmatrix} = \begin{pmatrix} X_{panel,r} & X_{panel,g} & X_{panel,b} \\ Y_{panel,r} & Y_{panel,g} & Y_{panel,b} \\ Z_{panel,r} & Z_{panel,g} & Z_{panel,b} \end{pmatrix}^{-1} \begin{pmatrix} X_{tgt,n+1} \\ Y_{tgt,n+1} \\ Z_{tgt,n+1} \end{pmatrix} \qquad \text{[Equation 2]}$$

$$X_{tgt,n+1} = X_{tgt,n} \frac{X_{tgt}}{X_{panel}}$$

$$Y_{tgt,n+1} = Y_{tgt,n} \frac{Y_{tgt}}{Y_{panel}}$$

$$Z_{tgt,n+1} = Z_{tgt,n} \frac{Z_{tgt}}{Z_{panel}},$$

wherein ($X_{tgt,n}$, $Y_{tgt,n}$, $Z_{tgt,n}$) denotes a tristimulus value of the $n^{th}$ target, ($X_{panel}$, $Y_{panel}$, $Z_{panel}$) denotes a tristimulus value measured by the display characteristic measurement unit 160, and ($X_{tgt}$, $Y_{tgt}$, $Z_{tgt}$) denotes a tristimulus value of a desirable final output target.

The storage unit 130 stores the lookup table created by the display characteristic correction unit 120. That is, the storage unit 130 stores a lookup table for the neutral color, a lookup table for the pure chromatic color, and a lookup table for the composite color. The lookup tables stored in the storage unit 130 are illustrated in the following tables 1, 2, and 3:

TABLE 1

| Input | | | | Luminance | | |
|---|---|---|---|---|---|---|
| R | G | B | Saturation | R | G | B |
| 0 | 0 | 0 | 0 | 0.00 | 0.00 | 0.00 |
| 45 | 45 | 45 | 0 | 0.03 | 0.02 | 0.01 |
| 90 | 90 | 90 | 0 | 0.13 | 0.09 | 0.07 |
| 135 | 135 | 135 | 0 | 0.28 | 0.23 | 0.19 |
| 180 | 180 | 180 | 0 | 0.50 | 0.45 | 0.41 |
| 225 | 225 | 225 | 0 | 0.78 | 0.75 | 0.72 |
| 255 | 255 | 255 | 0 | 1.00 | 1.00 | 1.00 |

Table 1 illustrates a lookup table for a neutral color having a saturation value of 0.

TABLE 2

| Input | | | | Luminance | | |
|---|---|---|---|---|---|---|
| R | G | B | Saturation | R | G | B |
| 0 | 0 | 0 | 0 | 0.00 | 0.00 | 0.00 |
| 45 | 0 | 0 | 1 | 0.02 | 0.02 | 0.02 |
| 90 | 0 | 0 | 1 | 0.10 | 0.10 | 0.10 |
| 135 | 0 | 0 | 1 | 0.25 | 0.25 | 0.25 |
| 180 | 0 | 0 | 1 | 0.47 | 0.47 | 0.47 |
| 225 | 0 | 0 | 1 | 0.76 | 0.76 | 0.76 |
| 255 | 0 | 0 | 1 | 1.00 | 1.00 | 1.00 |

Table 2 illustrates a lookup table for a pure chromatic color having a saturation value of 1. The pure chromatic color illustrated in table 2 is a red color and thus is free from green and blue.

TABLE 3

| Input | | | | Luminance | | |
|---|---|---|---|---|---|---|
| R | G | B | Saturation | R | G | B |
| 0 | 0 | 0 | 0 | 0.00 | 0.00 | 0.00 |
| 255 | 255 | 45 | 0.82 | 0.02 | 0.02 | 0.02 |
| 255 | 255 | 90 | 0.65 | 0.11 | 0.10 | 0.09 |
| 255 | 255 | 135 | 0.47 | 0.27 | 0.24 | 0.22 |
| 255 | 255 | 180 | 0.29 | 0.49 | 0.45 | 0.42 |
| 225 | 255 | 225 | 0.12 | 0.78 | 0.75 | 0.73 |
| 255 | 255 | 255 | 1 | 1.00 | 1.00 | 1.00 |

Table 3 illustrates a lookup table for a composite color a saturation value of which is neither 0 nor 1.

The composite color luminance determination unit 140 determines luminance of the composite color using luminance of the neutral color and luminance of the pure chromatic color. The composite color luminance determination unit 140 determines the type of color based on the saturation value calculated by the saturation calculation unit 110.

The composite color luminance determination unit 140 determines luminance of the composite color using a corresponding lookup table stored in the storage unit 130 based on the saturation value calculated by the saturation calculation unit 110.

If a saturation value calculated by the saturation calculation unit 110 is 0, the composite color luminance determination unit 140 extracts corresponding luminance from the lookup table for the neutral color. If a saturation value is 1, the composite color luminance determination unit 140 extracts corresponding luminance from the lookup table for the pure chromatic color. If a saturation value is neither 0 nor 1, the composite color luminance determination unit 140 extracts corresponding luminance from the lookup table for the composite color.

Alternatively, the composite color luminance determination unit 140 may calculate luminance of the neutral color and luminance of the pure chromatic color using the following equation 3 without using the lookup table:

$$TY_{Wn} = \left(\frac{n}{255}\right)^{T_{Gamma}} \times Y_{W255} + Y_{W0} \quad \text{[Equation 3]}$$

wherein 'n' ranges from 0 to 255, $TY_{Wn}$, denotes target luminance for the $n^{th}$ input grayscale, $Y_{W255}$ denotes a white luminance if an input grayscale is at a maximum level, $Y_{W0}$ denotes a black luminance if an input grayscale is at a minimum level, and $T_{Gamma}$ denotes a target gamma.

The composite color luminance determination unit 140 calculates luminance of the composite color using the luminance of the neutral color and the luminance of the pure chromatic color extracted from the lookup tables or calculated by equation 3 and using the following equation 4:

$$Y_{composite\text{-}n}=(1-S)Y_{neutral\text{-}n}+SY_{pure\text{-}n} \quad \text{[Equation 4]}$$

wherein, $Y_{composite\text{-}n}$ denotes composite color luminance for the $n^{th}$ input grayscale, 'S' denotes a saturation, $Y_{neutral\text{-}n}$ denotes luminance of the neutral color for the $n^{th}$ input grayscale, and $Y_{pure\text{-}n}$ denotes luminance of the pure chromatic color for the $n^{th}$ input grayscale.

The display unit 150 displays an image signal using the luminance of the neutral color, the pure chromatic color, and the composite color. If the luminance changes, a grayscale voltage corresponding to a suitable gamma is output. Accordingly, the display unit 150 displays the image signal with a gamma changed by the luminance determined by the display characteristic correction unit 120 and the composite color luminance determination unit 140.

The display characteristic measurement unit 160 measures a display characteristic parameter from the image signal displayed on the display unit 150. The display characteristic parameter measured by the display characteristic measurement unit 160 is provided to the display characteristic correction unit 120.

Figure 2:
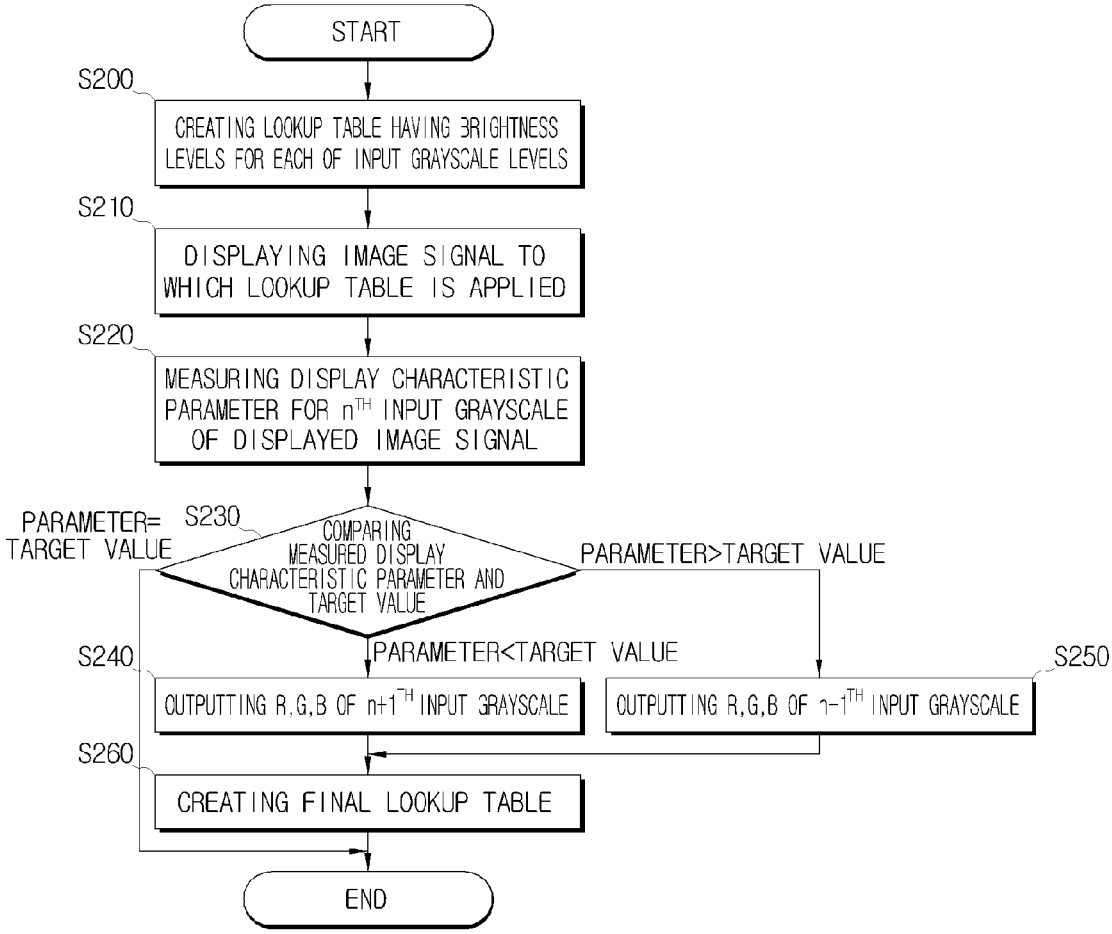
FIG. 2 is a flowchart illustrating a method for creating a lookup table according an exemplary embodiment of the present invention.

FIG. 2 is a flowchart illustrating a method for creating a lookup table according to an exemplary embodiment of the present invention.

The display characteristic correction unit 120 creates a lookup table having luminance levels for each of input grayscale levels (S200), and then displays an image signal to which the created lookup table is applied through the display unit 150 (S210).

If the image single is displayed by the display unit 150, the display characteristic measurement unit 160 measures a display characteristic parameter for the n h input grayscale of the displayed image signal, and provides the measuring result to the display characteristic correction unit 120 (S220).

The display characteristic correction unit 120 compares the display characteristic parameter measured by the display characteristic measurement unit 160 with a preset target value (S230). If the measured display characteristic parameter is less than the target value, R, G, B of the $n+1^{th}$ input grayscale are output (S240), and if the measured display characteristic parameter is larger than the target value, R, G, B of the $n-1^{th}$ input grayscale are output (250).

The display characteristic correction unit 120 repeats the operation of comparing the display characteristic parameter with the preset target value for the entire input grayscales, thereby generating a final lookup table (S260).

If the display characteristic parameter measured by the display characteristic measurement unit 160 is equal to the preset target value, the display characteristic correction unit 120 is not required to generate a final lookup table and instead uses the initially created lookup table.

Figure 3:
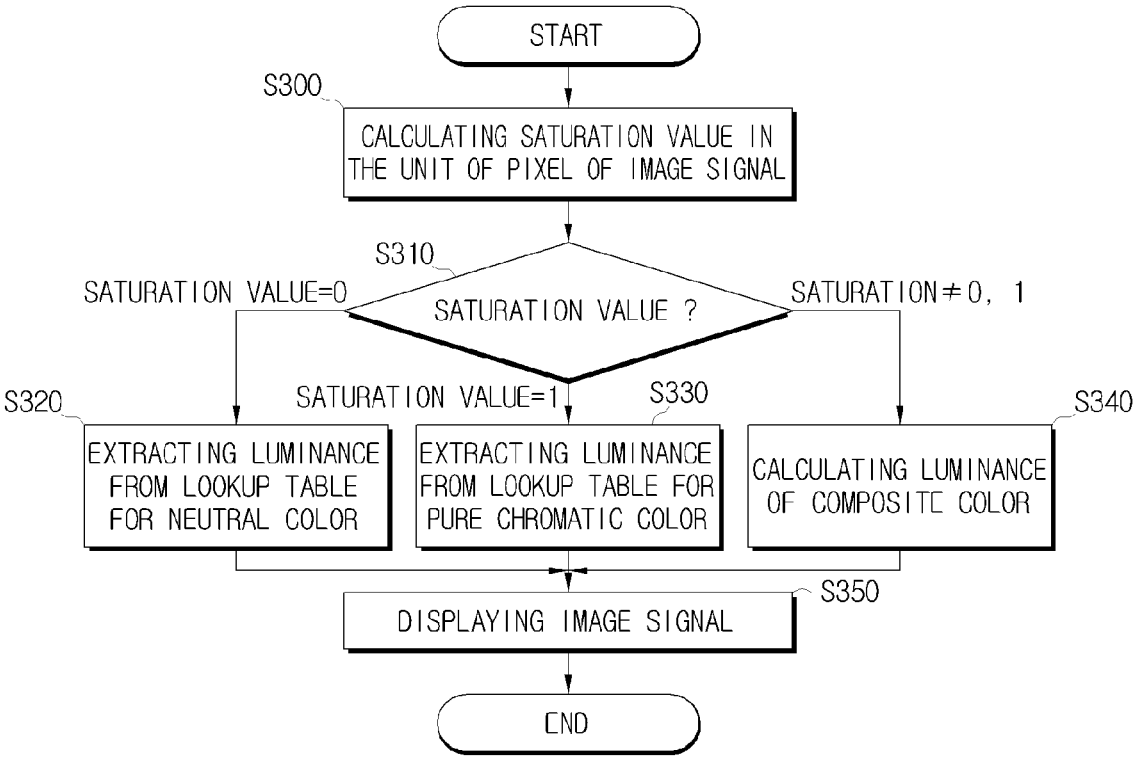
FIG. 3 is a flowchart illustrating a method for using a lookup table according to a saturation value.

FIG. 3 is a flowchart illustrating a method for using a lookup table according to a saturation value.

The saturation calculation unit 110 calculates a saturation value in the pixels of an image signal (S300). The saturation calculation unit 110 may use equation 1 mentioned above to calculate a saturation value.

The composite color luminance determination unit 140 selects how to determine luminance according to the calculated saturation value (S310).

The composite color luminance determination unit 140 extracts luminance from a lookup table for a neutral color if the saturation value is 0 (S320), extracts luminance from a lookup table for a pure chromatic color if the saturation value is 1 (S330), and if the saturation value is neither 0 nor 1, calculates luminance of a composite color using the luminance of the neutral color and the luminance of the pure chromatic value and equation 4 (S340).

If the luminance of the neutral color, the pure chromatic color, and the composite color are determined in operations S320, S330, and S340, the display unit 150 displays an image signal by reflecting on the determined luminance (S350).

Figure 4:
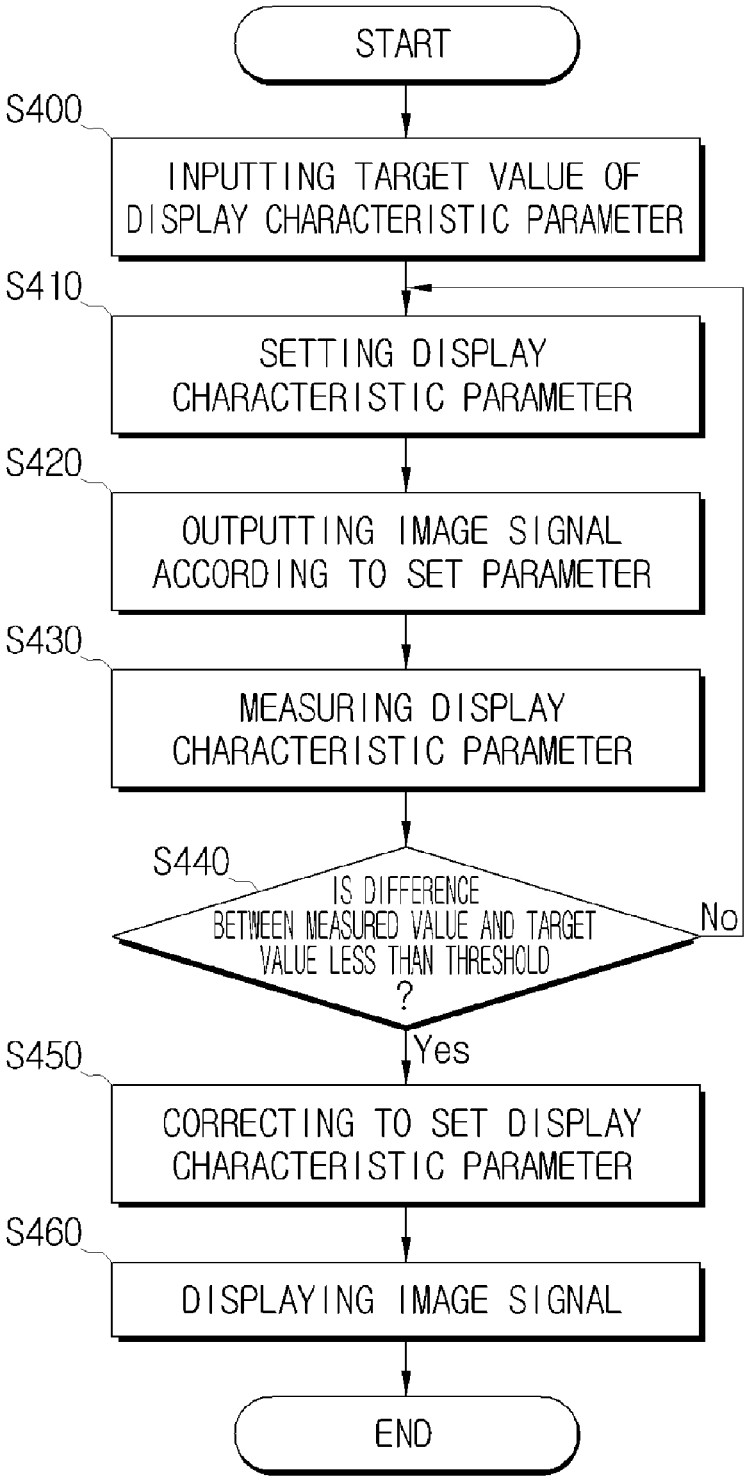
FIG. 4 is a flowchart illustrating a method for correcting a display characteristic of an image display device according to an exemplary embodiment of the present invention.

FIG. 4 is a flowchart illustrating a method for correcting a display characteristic of an image display device according to an exemplary embodiment of the present invention.

The display characteristic correction unit 120 receives a target value of a display characteristic parameter (S400). The display characteristic parameter may be input by a user through a user interface (not shown) or may be previously set. The target value may include a white luminance, a black luminance, a neutral color gamma, neutral color coordinates, and a pure chromatic color gamma.

The display characteristic correction unit 120 sets a display characteristic parameter to apply in displaying an image signal through the display unit 150 (S410).

The display unit 150 applies the display characteristic parameter set by the display characteristic correction unit 120 to the image signal and displays the image signal (S420).

If the display unit 150 displays the image signal, the display characteristic measurement unit 160 measures a display characteristic parameter from the image signal displayed by the display unit 150 (S430).

The display characteristic correction unit 120 receives the display characteristic parameter from the display characteristic measurement unit 160, and compares a difference between the measured display characteristic parameter and the target value with a threshold (S440).

If the difference between the measured display characteristic parameter and the target value is less than the threshold in operation S440 (S440—Y), the display characteristic correction unit 120 corrects the measured display characteristic parameter such that the preset display characteristic parameter is applied to the display unit 150 (S450), and the display unit 150 displays the image signal (S460).

If the difference between the measured display characteristic parameter and the target value is larger than the threshold in operation S440 (S440—N), the display characteristic correction unit 120 sets a new display characteristic parameter (S410). Then the processes resumes from operation S410.

According to the image display device and the method for correcting the display characteristic thereof according to the exemplary embodiments of the present invention, since independent lookup tables are adopted for the neutral color and the pure chromatic color to correct a gamma and the luminance of the neutral color and the pure chromatic color are used to correct the gamma of the composite color, a grayscale linearity of the displayed image stably appears and an optimal gamma correction can be performed.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An image display device, comprising:

a composite color luminance determination unit which determines luminance of a composite color using luminance of a neutral color and luminance of a pure chromatic color;

a display unit which displays an image signal using the luminance of the neutral color, the luminance of the pure chromatic color and the determined luminance of the composite color;

a display characteristic measurement unit which measures a display characteristic parameter from the displayed image signal; and a display characteristic correction unit which corrects a display characteristic according to a result of comparing the measured display characteristic parameter and a preset target value.

2. The image display device as claimed in claim 1, wherein the display characteristic correction unit creates a lookup table having luminance levels for each of a plurality of input grayscale levels required to reproduce the preset target value, wherein the display unit displays the image signal to which the lookup table is applied, wherein the display characteristic measurement unit measures a display characteristic parameter from the displayed image signal with the lookup table applied, and wherein the display characteristic correction unit creates a final lookup table according to a result of comparing the measured display characteristic parameter from the displayed image signal with the lookup table applied and the preset target value.

3. The image display device as claimed in claim 2, wherein the display characteristic correction unit creates a lookup table for each of the neutral color, the pure chromatic color, and the composite color.

4. The image display device as claimed in claim 3, wherein the composite color luminance determination unit extracts the luminance of the neutral color and the luminance of the pure chromatic color from the created lookup tables to determine the luminance of the composite color.

5. The image display device as claimed in claim 3, further comprising a saturation calculation unit which calculates a saturation value of each pixel of the image signal, wherein the composite color luminance determination unit extracts luminance levels from the lookup table for the neutral color if the calculated saturation value is 0, extracts luminance levels from the lookup table for the pure chromatic color if the calculated saturation value is 1, and extracts luminance levels from the lookup table for the composite color if the calculated saturation value is neither 0 nor 1.

6. The image display device as claimed in claim 5, wherein the saturation calculation unit calculates the saturation value of each pixel by the following equation:

$$S = 1 - \frac{\mathrm{Min}(R, G, B)}{\mathrm{Max}(R, G, B)}$$

wherein 'S' denotes the saturation value, Min(R,G,B) denotes a minimum value of red (R), green (G), and blue (B), and Max(R,G,B) denotes a maximum value of R, G, B.

7. The image display device as claimed in claim 1, wherein the composite color luminance determination unit calculates the luminance of the neutral color and the luminance of the pure chromatic color by the following equation:

$$TY_{Wn} = \left(\frac{n}{255}\right)^{T_{Gamma}} \times Y_{W255} + Y_{W0}$$

wherein 'n' ranges from 0 to 255, $TY_{Wn}$ denotes target luminance for an $n^{th}$ input grayscale, $Y_{W255}$ denotes a white luminance if an input grayscale is at a maximum level, $Y_{W0}$ denotes a black luminance if an input grayscale is at a minimum level, and $T_{Gamma}$ denotes a target gamma.

8. The image display device as claimed in claim 1, wherein the composite color luminance determination unit calculates luminance of the composite color by the following equation:

$$Y_{composite\text{-}n} = (1-S)Y_{neutral\text{-}n} + SY_{pure\text{-}n}$$

wherein 'n' ranges from 0 to 255, $Y_{composite\text{-}n}$ denotes composite color luminance for an $n^{th}$ input grayscale, 'S' denotes a saturation value, $Y_{neutral\text{-}n}$ denotes luminance of the neutral color for the $n^{th}$ input grayscale, and $Y_{pure\text{-}n}$ denotes luminance of the pure chromatic color for the $n_{th}$ input grayscale.

9. The image display device as claimed in claim 2, wherein if the display characteristic parameter measured for an $n^{th}$ input grayscale is less than the target value, the display characteristic correction unit outputs red (R), green (G), blue (B) of an $n+1^{th}$ input grayscale, wherein 'n' ranges from 0 to 255.

10. The image display device as claimed in claim 2, wherein if the display characteristic parameter measured for an $n^{th}$ input grayscale is greater than the target value, the display characteristic correction unit outputs red (R), green (G), blue (B) of an $n-1^{th}$ input grayscale, wherein 'n' ranges from 0 to 255.

11. The image display device as claimed in claim 2, wherein the display characteristic correction unit corrects the display characteristic by the following equation:

$$\begin{pmatrix} R_{n+1} \\ G_{n+1} \\ B_{n+1} \end{pmatrix} = \begin{pmatrix} X_{panel,r} & X_{panel,g} & X_{panel,b} \\ Y_{panel,r} & Y_{panel,g} & Y_{panel,b} \\ Z_{panel,r} & Z_{panel,g} & Z_{panel,b} \end{pmatrix}^{-1} \begin{pmatrix} X_{tgt,n+1} \\ Y_{tgt,n+1} \\ Z_{tgt,n+1} \end{pmatrix}$$

-continued $$X_{tgt,n+1} = X_{tgt,n}\frac{X_{tgt}}{X_{panel}}$$

$$Y_{tgt,n+1} = Y_{tgt,n}\frac{Y_{tgt}}{Y_{panel}}$$

$$Z_{tgt,n+1} = Z_{tgt,n}\frac{Z_{tgt}}{Z_{panel}},$$

wherein $(X_{tgt,n}, Y_{tgt,n}, Z_{tgt,n})$ denotes a tristimulus value of an $n^{th}$ target, $(X_{panel}, Y_{panel}, Z_{panel})$ denotes a tristimulus value measured by the display characteristic measurement unit, $(X_{tgt}, Y_{tgt}, Z_{tgt})$ denotes a tristimulus value of a desirable final output target, 'n' ranges from 0 to 255, and ($R_{n+1}$, $G_{n+1}$, and $B_{n+1}$) denotes red (R), green (G), blue (B) value of an $n+1^{th}$ input grayscale.

12. A method for correcting a display characteristic of an image display device, the method comprising:

determining luminance of a composite color using luminance of a neutral color and luminance of a pure chromatic color;

displaying an image signal using the luminance of the neutral color, the luminance of the pure chromatic color and the determined luminance of the composite color;

measuring a display characteristic parameter from the displayed image signal; and correcting a display characteristic according to a result of comparing the measured display characteristic parameter and a preset target value.

13. The method as claimed in claim 12, further comprising:

creating a lookup table having luminance levels for each of a plurality of input grayscale levels required to reproduce the preset target value;

displaying an image signal to which the lookup table is applied;

measuring a display characteristic parameter from the displayed image signal with the lookup table applied; and creating a final lookup table according to a result of comparing the measured display characteristic parameter from the displayed image signal with the lookup table applied and the preset target value.

14. The method as claimed in claim 13, wherein the creating the final lookup table comprises creating a lookup table for each of the neutral color, the pure chromatic color, and the composite color.

15. The method as claimed in claim 14, wherein the determining the luminance of the composite color comprises extracting the luminance of the neutral color and the luminance of the pure chromatic color from the created lookup tables to determine the luminance of the composite color.

16. The method as claimed in claim 14, further comprising calculating a saturation value of each pixel of the image signal, wherein the determining the luminance of the composite color comprises extracting luminance levels from the lookup table for the neutral color if the calculated saturation value is 0, extracting luminance levels from the lookup table for the pure chromatic color if the calculated saturation value is 1, and extracting luminance levels from the lookup table for the composite color if the calculated saturation is neither 0 nor 1.

17. The method as claimed in claim 16, wherein the calculating the saturation value comprises calculating the saturation value of each pixel by the following equation:

$$S = 1 - \frac{\mathrm{Min}(R, G, B)}{\mathrm{Max}(R, G, B)}$$

wherein 'S' denotes the saturation value, Min(R,G,B) denotes a minimum value of red (R), green (G), blue (B), and Max(R,G,B) denotes a maximum value of R, G, B.

18. The method as claimed in claim 12, wherein the determining the luminance of the composite color comprises calculating the luminance of the neutral color and the luminance of the pure chromatic color by the following equation:

$$TY_{Wn} = \left(\frac{n}{255}\right)^{T_{Gamma}} \times Y_{W255} + Y_{W0}$$

wherein 'n' ranges from 0 to 255, $TY_{Wn}$ denotes target luminance for an $n^{th}$ input grayscale, $Y_{W255}$ denotes white luminance if an input grayscale is at a maximum level, $Y_{W0}$ denotes black luminance if an input grayscale is at a minimum level, and $T_{Gamma}$ denotes a target gamma.

19. The method as claimed in claim 12, wherein the determining the luminance of the composite color comprises calculating the luminance of the composite color by the following equation:

$$Y_{composite\text{-}n} = (1-S)Y_{neutral\text{-}n} + SY_{pure\text{-}n}$$

wherein 'n' ranges from 0 to 255, $Y_{composite\text{-}n}$ denotes composite color luminance for the $n^{th}$ input grayscale, 'S' denotes a saturation value, $Y_{neutral\text{-}n}$ denotes luminance of the neutral color for the $n^{th}$ input grayscale, and $Y_{pure\text{-}n}$ denotes luminance of the pure chromatic color for the $n_{th}$ input grayscale.

20. The method as claimed in claim 13, wherein the correcting the display characteristic comprises outputting red (R), green (G), blue (B) of an $n+1^{th}$ input grayscale if the display characteristic parameter measured for an $n^{th}$ input grayscale is less than the target value, wherein 'n' ranges from 0 to 255.

21. The method as claimed in claim 13, wherein the correcting of the display characteristic outputs red (R), green (G), blue (B) of the $n-1^{th}$ input grayscale if the display characteristic parameter measured for the $n^{th}$ input grayscale is greater than the target value, wherein 'n' ranges from 0 to 255.

22. The method as claimed in claim 13, wherein the correcting the display characteristic comprises correcting the display characteristic by the following equation:

$$\begin{pmatrix} R_{n+1} \\ G_{n+1} \\ B_{n+1} \end{pmatrix} = \begin{pmatrix} X_{panel,r} & X_{panel,g} & X_{panel,b} \\ Y_{panel,r} & Y_{panel,g} & Y_{panel,b} \\ Z_{panel,r} & Z_{panel,g} & Z_{panel,b} \end{pmatrix}^{-1} \begin{pmatrix} X_{tgt,n+1} \\ Y_{tgt,n+1} \\ Z_{tgt,n+1} \end{pmatrix}$$

$$X_{tgt,n+1} = X_{tgt,n} \frac{X_{tgt}}{X_{panel}}$$

$$Y_{tgt,n+1} = Y_{tgt,n} \frac{Y_{tgt}}{Y_{panel}}$$

$$Z_{tgt,n+1} = Z_{tgt,n} \frac{Z_{tgt}}{Z_{panel}},$$

wherein $(X_{tgt,n}, Y_{tgt,n}, Z_{tgt,n})$ denotes a tristimulus value of an $n^{th}$ target, $(X_{panel}, Y_{panel}, Z_{panel})$ denotes a tristimulus value measured by the display characteristic measurement unit, $(X_{tgt}, Y_{tgt}, Z_{tgt})$ denotes a tristimulus value of a desirable final output target, 'n' ranges from 0 to 255, and $(R_{n+1}, G_{n+1}$, and $B_{n+1})$ denotes red (R), green (G), blue (B) value of an $n+1^{th}$ input grayscale.

23. The image display device as claimed in claim 1, wherein the neutral color is a color that includes a non-zero red (R) component, a non-zero blue (B) component, and a non-zero green (G) component mixed in a same ratio, the pure chromatic color is a color that includes only one of the non-zero R component, the non-zero B component, and the non-zero G component, and the composite color is a color that includes at least two of the non-zero R component, the non-zero B component, and the non-zero G component.

24. The method as claimed in claim 12, wherein the neutral color is a color that includes a non-zero red (R) component, a non-zero blue (B) component, and a non-zero green (G) component mixed in a same ratio, the pure chromatic color is a color that includes only one of the non-zero R component, the non-zero B component, and the non-zero G component, and the composite color is a color that includes at least two of the non-zero R component, the non-zero B component, and the non-zero G component.

* * * * *